US007272333B2

(12) United States Patent
Mizes

(10) Patent No.: US 7,272,333 B2
(45) Date of Patent: Sep. 18, 2007

(54) IMAGE QUALITY MEASUREMENTS USING LINEAR ARRAY IN SPECULAR MODE

(75) Inventor: Howard Mizes, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 62 days.

(21) Appl. No.: 11/170,598

(22) Filed: Jun. 30, 2005

(65) Prior Publication Data

US 2007/0003302 A1 Jan. 4, 2007

(51) Int. Cl.
*G03G 15/00* (2006.01)

(52) U.S. Cl. ..... 399/49; 399/72; 399/60

(58) Field of Classification Search ..... 399/49, 399/60, 72, 74
See application file for complete search history.

(56) References Cited

U.S. PATENT DOCUMENTS

| | | | | |
|---|---|---|---|---|
| 4,553,033 | A | 11/1985 | Hubble, III et al. | |
| 4,750,838 | A | 6/1988 | De Wolf et al. | |
| 4,796,065 | A | 1/1989 | Kanbayashi | |
| 4,799,082 | A | 1/1989 | Suzuki | |
| 4,801,980 | A | 1/1989 | Arai et al. | |
| 4,989,985 | A | 2/1991 | Hubble, III et al. | |
| 5,083,161 | A | 1/1992 | Borton et al. | |
| 5,204,538 | A | 4/1993 | Genovese | |
| 5,337,122 | A * | 8/1994 | Hubble et al. | 399/49 |
| 5,722,009 | A * | 2/1998 | Haneda et al. | 399/49 |
| 5,887,221 | A * | 3/1999 | Grace | 399/49 |
| 6,337,958 | B1 * | 1/2002 | Stanich et al. | 399/49 |
| 6,526,240 | B1 | 2/2003 | Thomas et al. | |
| 6,690,471 | B2 | 2/2004 | Tandon et al. | |
| 6,842,266 | B1 | 1/2005 | Farnung et al. | |
| 2001/0004425 | A1 * | 6/2001 | Shinohara et al. | 399/49 |

* cited by examiner

*Primary Examiner*—David M. Gray
*Assistant Examiner*—Laura K Roth
(74) *Attorney, Agent, or Firm*—Pillsbury Winthrop Shaw Pittman, LLP

(57) ABSTRACT

A method and system for controlling a printing device's tone reproduction curve, which may minimize contouring and help maximize the number of shades or colors available for an output image.

18 Claims, 6 Drawing Sheets

IMAGE QUALITY MEASUREMENTS USING LINEAR ARRAY IN SPECULAR MODE

BACKGROUND

All references cited in this specification, and their references, are incorporated by reference herein where appropriate for teachings of additional or alternative details, features, and/or technical background.

Disclosed in the embodiments described herein is a method and system for controlling a printing device's tone reproduction curve. Control of the tone reproduction curve may minimize contouring, help maximize the number of shades or colors available for an output image, and maintain the desired output color. While certain elements of this disclosure will be described in reference to a xerographic print engine, it is also amenable to other electrophotographic processes such as, for example, ionographic print engines and like applications.

Electrophotographic copiers, printers and digital imaging systems typically record an electrostatic latent image on an imaging member. The latent image corresponds to the informational areas contained within a document being reproduced. In xerographic systems, a uniform charge is placed on a photoconductive member and portions of the photoconductive member are discharged by a scanning laser or other light source to create the latent image. In ionographic print engines the latent image is written to an insulating member by a beam of charge carriers, such as, for example, electrons. However it is created, the latent image is then developed by bringing a developer, including colorants, such as, for example, toner particles into contact with the latent image. The toner particles carry a charge and are attracted away from a toner supply and toward the latent image by an electrostatic field related to the latent image, thereby forming a toner image on the imaging member. The toner image is subsequently transferred to a physical media, such as a copy sheet. The copy sheet, having the toner image thereon, is then advanced to a fusing station for permanently affixing the toner image to the copy sheet.

The approach utilized for multi-color electrophotographic printing is substantially identical to the process described above. However, rather than forming a single latent image on the photoconductive surface in order to reproduce an original document, as in the case of black and white printing, multiple latent images corresponding to each color separation are recorded on one or more photoconductive surfaces. The electrostatic latent image for each color separation is developed with toner of that color. Thereafter, each color separation is ultimately transferred to the copy sheet in superimposed registration with the other toner images, creating, for example, a multi-layered toner image on the copy sheet. This multi-layer toner image is permanently affixed to the copy sheet in substantially conventional manner to form a finished copy.

FIG. 1 is a simplified elevational view of essential elements of one type of a color printer, showing a context in which embodiments of the present disclosure may be utilized. Specifically, there is shown an "image-on-image" xerographic color printer, in which successive primary-color images are accumulated on a photoreceptor belt, and the accumulated superimposed images are in one step directly transferred to an output sheet as a full-color image.

Specifically, the color printer of FIG. 1 includes a belt photoreceptor 10, along which are disposed a series of stations, as is generally familiar in the art of xerography, one set for each primary color to be printed. For instance, to place a cyan color separation image on photoreceptor 10, there is used a charge corotron 12C, an imaging laser 14C, and a development unit 16C. For successive color separations, there is provided equivalent elements 12M, 14M, 16M (for magenta), 12Y, 14Y, 16Y (for yellow), and 12K, 14K, 16K (for black). The successive color separations are built up in a superimposed manner on the surface of photoreceptor 10, and then the combined full-color image is transferred at transfer station 20 to an output sheet. The output sheet is then run through a fuser 30, as is familiar in xerography.

Also shown in FIG. 1 is a set of what can be generally called "monitors," such as 50 and 52, which can feed back to a control device 54. The monitors such as 50 and 52 are devices which can make measurements to images created on the photoreceptor 10 (such as monitor 50) or to images which were transferred to an output sheet (such as monitor 52). These monitors can be in the form of optical densitometers, calorimeters, electrostatic voltmeters, etc. There may be provided any number of monitors, and they may be placed anywhere in the printer as needed, not only in the locations illustrated. The information gathered therefrom is used by control device 54 in various ways to control in the operation of the printer, whether in a real-time feedback loop, an offline calibration process, a registration system, etc.

An image to be rendered (an input image) is received in the form of, or is transformed into the form of, a set of contone values. For example, each contone can have a value ranging from 0 to 255 (in eight bit systems) or from 0 to 4095 (in higher resolution twelve bit systems). The contone values are indicative of how much colorant should be applied to the output medium in order to render a small portion of the image. For example, 255 may indicate that no colorant should be applied to a small portion of the medium and a contone value of zero may indicate that the entire area associated with a halftone cell should be covered with toner. An Engine Response Curve (ERC) gives the relationship between the amount of mass developed to the paper or to an internal media and the contone gray level. If the ERC is not optimal, a tone reproduction curve (TRC) can be incorporated.

The tone reproduction curve (TRC) modifies the input gray level before it is sent to the print engine. The TRC is adjusted in order to maintain a stable system reproduction curve (SRC). The resulting image processing system TRC changes the input gray level to obtain a stable SRC. In particular, image processing system tone reproduction curves may be created during the product development phase and stored in data files on the actual device, or, for example, in the accompanying driver or software files. Therefore, each possible mode and each possible combination of image adjustment, such as contrast and brightness, has an associated image processing system tone reproduction curve stored in a data file. The data file corresponding to the image input terminal information and the image output terminal information is then referenced and applied by the image processing sub-system to the input image information.

Some electrophotographic systems include a hierarchical control scheme in an attempt to provide an actual system reproduction curve that is as close as possible to the ideal or target system reproduction curve. For example, some electrophotographic systems include what are referred to as level 1 control loops for maintaining electrophotographic actuators at associated set points, level 2 control loops for selecting set points for the level 1 control loops. These give a stable ERC. Level 3 controls adjust the TRC if ERC stability cannot be maintained to achieve a stable SRC.

Xerographic actuators include, for example, cleaning field strength or voltage, development field strength or voltage, imager or laser power, and AC wire voltage associated with some developers. In some xerographic environments level 1 control loops include electrostatic voltmeters for measuring charge voltage generated by charge applied to a photoconductive member. For instance, the electrostatic voltmeters measure the charge applied in the area of test patches in inter-document or inter-page zones of the photoconductor. If measured voltages, such as, for example, a discharged area voltage, or a cleaning voltage of an area surrounding a discharged area deviate from set point values, level 1 control loops adjust xerographic actuators to return the measured voltages to set point potentials. For example, the level 1 control loops vary a charge or bias voltage applied to elements of a developer to adjust a resulting development field and/or cleaning filed. Additionally, the level 1 control loops may adjust a laser power to return a related discharge field back toward a discharge field set point.

The sensors for level 2 control loops include, for example, infrared densitometers. In xerographic environments, and perhaps in other electrophotographic environments, infrared densitometers are also known as Enhanced Toner Area Coverage Sensors ("ETACS"). The infrared densitometers or ETACS are used to measure, for example, the density of toner or colorant applied to or developed on the photoconductive member.

ETAC systems generally are designed to measure both specular and diffuse reflected light, calibrating the specular read using the diffuse read. The diffuse reflectance increases proportionally to the area coverage of toner on the surface of the photoreceptor and continues to increase as the toner coverage grows past a monolayer. The specular reflectance decreases proportional to the area coverage, and saturates at a lower response as the toner layer grows past a monolayer.

Typically, a printer using control systems which rely on monitors such as 50, 52 of FIG. 1 require the deliberate creation of what shall be here generally called interdocument zone patches which are developed and subsequently measured in various ways by one or another monitor. These test marks may be in the form of test patches of a desired darkness value, a desired color blend, or a particular structure, such as a line pattern; or they may be of a structure particularly useful for determining registration of superimposed images ("fiducial" or "registration" marks). Various image-quality systems, at various times, require test marks of specific types to be placed, with respect to FIG. 1, on photoreceptor 10 at specific locations. These interdocument zone patches may be made on photoreceptor 10 by one or more lasers such as 14C, 14M, 14Y, and 14K. As is familiar in the art of "laser printing," by coordinating the modulation of the various lasers with the motion of photoreceptor 10 and other hardware (such as rotating mirrors, etc., not shown), the lasers discharge areas on photoreceptor 10 to create the desired test marks, particularly after these areas are developed by their respective development units 16C, 16M, 16Y, 16K. The test marks must be placed on the photoreceptor 10 in locations where they can be subsequently measured by a (typically fixed) monitor elsewhere in the printer, for whatever purpose.

Methods for making such interdocument zone patches are known. For example, U.S. Pat. No. 6,526,240 is directed toward a versatile system for causing the printing hardware to create test marks of desired types, in desired locations on the photoreceptor or on an output sheet, on demand.

A set of test patches may be written in an interdocument or interpage zone on the photoconductor. The test patches are then developed and the amount or density of colorant or toner present in the test patches is measured. If the amount of colorant or toner in a test patch is incorrect or varies from a target test patch density, the level 2 control loops generate or select one or more new set points for the xerographic actuators of the level 1 control loops. For instance, if a high-density test patch, such as a test patch corresponding to a target density of 100 percent (e.g., contone value zero), includes too little colorant or toner (is less dense than the target density), then the level 2 control loop may increase a set point related to the generation of a development field.

If the measured or actual density of a low-density test patch, or a test patch associated with a low-target density, such as, for example, 10 percent (e.g., a contone value of 25 or 26), includes more colorant or toner than is indicated by the associated target density, the level 2 controls may select or determine a new set point for a level 1 control loop associated with controlling a cleaning field voltage. For instance, increasing the cleaning field may reduce a toner density measured in a next low-density test patch. If an infrared densitometer measures a deviation from a midrange target density in an associated test patch, the level 2 controls may select or determine a new set point for a level 1 controller responsible for regulating laser power.

The level 2 control loops strive to maintain the actual densities of test patches at desired or target levels. The assumption is that by adjusting the level 1 actuator set points to maintain the densities of a few test patches at target levels, an entire actual TRC will be maintained at or near an ideal or target TRC.

FIG. 2 is a plan view of a portion of photoreceptor 10. Within a printer such as shown in FIG. 1, the photoreceptor 10 will move in a process direction P. At any arbitrarily chosen location on the photoreceptor 10, there can be considered what is called an "imageable area" indicated as A. This imageable area may, but need not, correspond in some way to an area on which an image desired to be printed is placed (including a predetermined interdocument zone); it may, but need not, correspond to one or another physical "landmark" formed in or on photoreceptor 10, such as a seam or hole; indeed, the entire surface of the photoreceptor 10 may be considered the imageable area. However, the imageable area must define relative thereto an "origin" point, such as shown as (0, 0) in FIG. 2, from which any other point within the imageable area can be located, such as shown as (x, y). The coordinate system thus enabled can facilitate locating a desired test mark essentially anywhere in the imageable area. Numerous types of test marks may be used. In general, such marks frequently comprise different configured patches as set forth, for example, in FIGS. 3-5 of U.S. Pat. No. 6,526,240, commonly assigned.

Errors or deviations from the target TRC of the actual reproduction curve lead to errors in gray scale or color of images in output documents.

Some electrophotographic systems include a third level of control. Level 3 control loops may share the infrared densitometers of the level 2 control loops. Alternatively, level 3 control loops can include other sensors.

To implement level 3 control, a plurality of additional test patches are developed in inter page zones of an imaging member. The plurality of level 3 test patches is associated with a plurality of target level 3 test patch densities. The plurality of target level 3 test patch densities may or may not include the high, low and midrange target test patch densities described above. The level 3 controls use this information to build color correction lookup tables to be used in an image path of the system.

Many kinds of electrophotographic machines use multiple sensors, such as ETAC sensors, to monitor the developed mass. These sensors may monitor the developed mass for different colors (including just black) and different area coverages to infer the shape of the TRC and maintain color uniformity. ETAC systems may be calibrated by printing a series of test patches of different masses, measuring the masses directly by sucking off and weighing the toner and also monitoring the ETAC response. From these measurements, one can plot the measured mass versus the ETAC response, the plot being used as a calibration curve to infer the mass for any ETAC response. ETAC systems measuring both specular and diffuse light add to the cost of electrophotographic machines.

It would be useful to use a sensor with a more general sensing capability than an ETAC, yet a sensor that retains the ability to monitor the developed mass at low and high area coverages.

REFERENCES

U.S. Pat. No. 4,553,033 discloses an infrared reflectance densitometer including a light emitting diode, a collimating lens through which light is projected to a photosensitive surface, a collector lens and a field lens through which reflected light is focused onto a signal photodiode, and a control photodiode onto which a portion of reflected light is directed to control light output. The amount of light received on the signal photodiode is a measurement of the reflectance from the surface of the photoreceptor which, in turn, is proportional to the density of the toner particles thereon.

U.S. Pat. No. 4,750,838 describes an optoelectric circuit for measuring differences in optical densities of an image carrier. An LED illuminates a test area. The light reflected from the surface is sensed by a phototransistor. The linear output of the LED is proportional to the image density. The circuit has a voltage follower, output transistor, amplifier and differential amplifier for controlling the image density measurements. The circuit has a range of density sensitivities between 0.0 and 1.5 mg/cm.sup.2.

U.S. Pat. No. 4,796,065 discloses an apparatus for detecting image density in an image forming machine by sensing either regular reflection or scattered reflection. A circuit having light emitting elements (LEDs or phototransistors), a pair of sensors, and a comparator is used for determining image density.

U.S. Pat. No. 4,799,082 describes an electrostatic reproducing apparatus having a light source and detector for detecting color toner density. A sensor is driven by a circuit which contains a power source, a safety resistor, operational amplifier, comparator and voltage dividing resistors for producing a signal representative of the light reflected from the image.

U.S. Pat. No. 4,801,980 discloses a toner density control apparatus which compares an image density of a reference image with a predetermined level to control density. Voltage to a light emitting element is controlled by the circuit which includes a sensor correction portion.

U.S. Pat. No. 4,989,985 describes an infrared densitometer which measures the reduction in the specular component of reflectivity as toner particles are progressively deposited on a moving photoconductive belt. Collimated light rays are projected onto the toner particles. The light rays reflected from at least the toner particles are collected and directed onto a photodiode array. The photodiode array generates electrical signals proportional to the total flux and the diffuse component of the total flux of the reflected light rays. Circuitry compares the electrical signals and determines the difference therebetween to generate an electrical signal proportional to the specular component of the total flux of the reflected light rays.

U.S. Pat. No. 5,083,161 describes an infrared densitometer which measures the reflectivity of a selected region on a surface by reflecting light rays from a single source off the selected region onto an array of photodiodes.

U.S. Pat. No. 5,204,538, commonly assigned, discloses an apparatus measures the reflectivity of a selected region of a surface. A first light beam is reflected from the selected region and substantially focused on a photodetector. A second light beam is reflected from the selected region and is substantially unfocused on the photodetector. A signal is derived representative of the direct reflectance of light reflected from the surface onto the photodetector as a function of the intensities of the focused light beam and the unfocused light beam detected by the photodetector.

U.S. Pat. No. 6,690,471, commonly assigned, relates to a color spectrophotometer, especially suitable for on-line color printer color control systems, incorporating a commercial imaging chip, which normally only forms part of a three row, three color, document imaging bar used for imaging documents in scanners, digital copiers, or multifunction products, having multiple photo-sites with at least three different color filters in three rows. This spectrophotometer may have a substantially reduced number of different LED or other spectral illumination sources, one of which may be for white light, yet provide multiple spectral data outputs from the differently filtered photo-sites being simultaneous illuminated by the light reflected from a color test target area which is being sequentially illuminated by the respective limited number of LEDs, enabling broad spectrum information and color control.

U.S. Pat. No. 6,697,582, commonly assigned, discloses an actual tone reproduction curve of an electrophotographic system is controlled at several points to coincide with a target tone reproduction curve. The several points are referred to as level 2 control points. The level 2 control points are dynamically selected to, for example, minimize an aspect of error between the actual tone reproduction curve and the target tone reproduction curve. Test patches are generated in association with target test patch densities. Actual test patch densities are measured. An approximation of the actual tone reproduction curve is fit to the measured data. New level 2 control points are selected to minimize an aspect of deviation or error between the actual tone reproduction curve and the target tone reproduction curve. A system operative to dynamically select the level 2 control points includes means for selecting optimum level 2 control points.

U.S. Pat. No. 6,842,266, commonly assigned, discloses an image processing system receives image input terminal information and image output terminal information. Based on the content of the image input terminal information and the image output terminal information a new system tone reproduction curve is determined. This device independent methodology allows system tone reproduction curves to be generated as needed, and allows the additional flexibility for changes in the image input terminal or the image output terminal.

SUMMARY

Aspects disclosed herein include:

a method of measuring variations in high mass on a photoreceptor in specular mode using a linear sensor array, the method comprising: printing a test patch comprising a solid area patch and one or more process direction lines using printing material on said photoreceptor; directing light onto said photoreceptor in a fashion to generate specular transmission to the linear sensor array; and measuring, by way of said linear sensor array, the average response of sensors on the array to the specular transmissions over the solid area patch and the width of the lines using the specular transmissions; and a system for improving image quality of a print from an electrophotographic printer comprising an illuminator providing light transmissions; a photoreceptor positionally configured to receive light transmissions from the illuminator; a linear sensor array comprising a plurality of sensors positionally configured with respect to the illuminator and the photoreceptor to obtain specular light transmissions from the photoreceptor resulting from the light transmissions from the illuminator; a test patch printer for printing test patches on the photoreceptor; a first processor operationally associated with the test patch printer and configured to cause the test patch printer to print one or more test patches comprising a solid area patch in association with one or more solid lines on the photoreceptor; a second processor operationally associated with the linear sensor array and operationally configured to process the specular light transmissions received by the linear sensor array to determine the average response of the sensors on the linear sensor array over the solid area patch of the test patch and to determine the width of the lines associated with the solid area patch of the test patch.

BRIEF DESCRIPTION OF THE DRAWINGS

Various of the above mentioned and further features and advantages will be better understood from this description of embodiments thereof, including the attached drawing figures wherein.

DETAILED DESCRIPTION

In embodiments, there is illustrated a method of measuring variations in high mass on a photoreceptor in specular mode using a linear sensor array, the method comprising: printing a test patch comprising a solid area patch and one or more lines using printing material on said photoreceptor; directing light onto the photoreceptor in a fashion to generate specular transmission to the linear sensor array; and measuring, by way of said linear sensor array, the average response of sensors on the array to the specular transmissions over the solid area patch and measuring, by the linear sensor array, the width of the lines using the specular transmissions. In such method, the lines may be oriented in the xerographic process direction in order to allow for the measurement of the lines. The linear sensor array may comprise a full width array or other linear sensor array. The photoreceptor may be a belt photoreceptor. To calibrate the sensor to the true mass, the mass in the solid area patch and/or lines may be measured, for example, directly by removing and weighing the printing material. The sensor may also be calibrated by measuring the optical density or color of the patch after it has been transferred and fused to paper. The method may also comprise correlating the average response of said sensors on the array in respect of the solid area patch to the developed mass of the solid area patch, and correlating the width of the lines to the measured mass of the patch.

In an embodiment, it is proposed to use an in-line linear sensor using specular mode illumination to measure test patterns on a photoreceptor or transfer belt internal to a printer to improve image quality. In such specular mode imaging embodiment, the sensor or monitor may give its maximum response when no toner is on the surface. The response attenuates as the developed toner mass increases (that is, the attenuation increases with the developed mass). Such in-line linear sensor may comprise an imaging scanner array, such as a full-width array ("FWA") sensor, for example a raster input scanner sensor bar.

Figure 1:
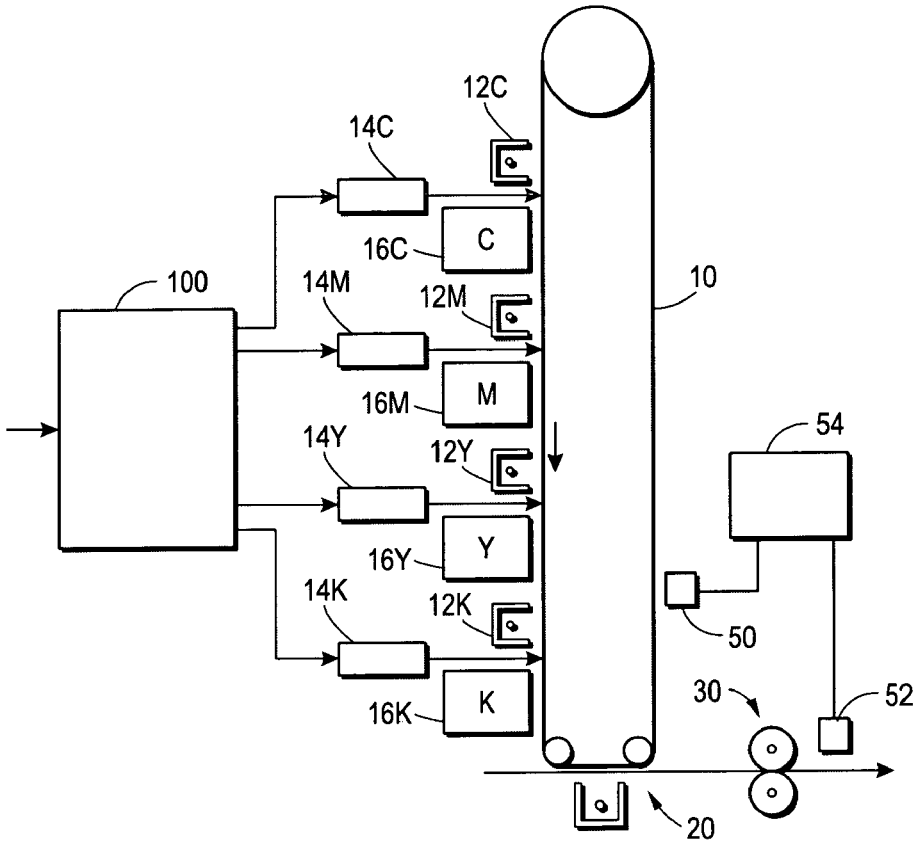
FIG. 1 (PRIOR ART)
FIG. 1 (prior art) is a simplified elevational view of essential elements of a xerographic color printer.
Figure 2:
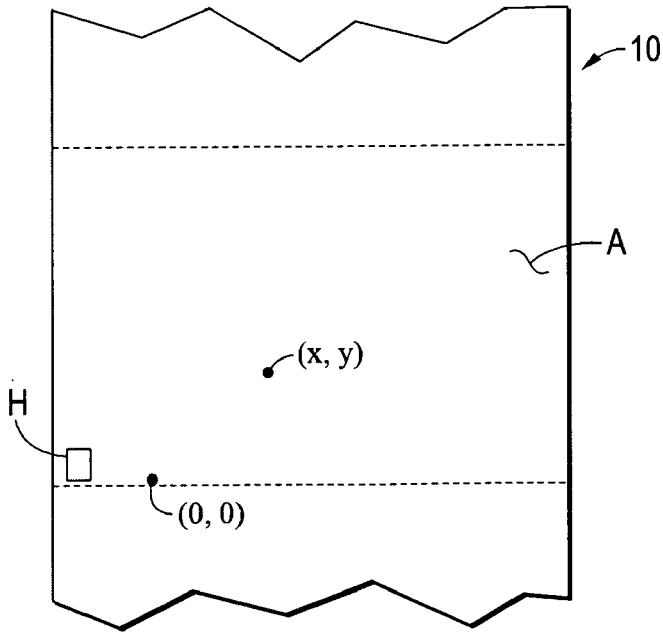
FIG. 2 (prior art) is a plan view of a portion of a photoreceptor.
Figure 3:
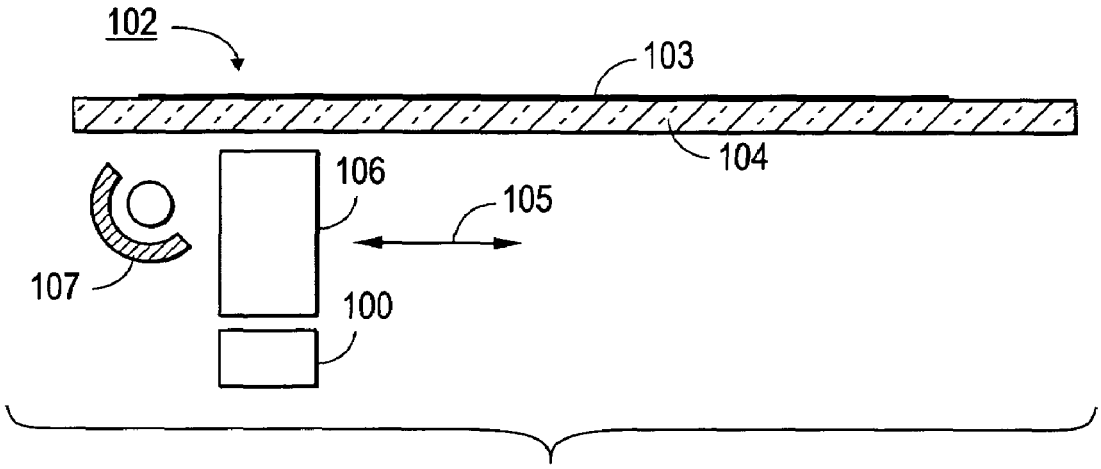
FIG. 3 (PRIOR ART)
FIG. 3 (prior art) is an elevational view showing an exemplary raster input scanner of a type that can be adapted as a sensor bar of the present disclosure.

Referring to FIG. 3, there is shown an exemplary raster input scanner of the type adaptable to use as scanning array (by which term it is meant to include a sensor bar) 100 in embodiments of the present disclosure. Scanning array 100 comprises a linear full width array having a scan width in the fast scan direction substantially equal to or slightly greater than the width of the largest document 103 or other object to be scanned. Documents to be scanned are supported on a generally rectangular transparent platen 104, typically glass, sized to accommodate the largest original document 103 to be scanned. A document 103 to be scanned is located either manually or by a suitable automatic document handler or feeder (not shown) on platen 104 for scanning. A scanning array 100 is supported for reciprocating scanning movement in the scan direction depicted by arrows 105 below platen 104 by a movable scanning carriage (not shown). A lens 106 focuses scanning array 100 on a line-like area extending across the width of platen 104. One or more lamp and reflector assemblies forming a light source 107 are provided for illuminating the line-like area on which scanning array 100 is focused.

Figure 4:
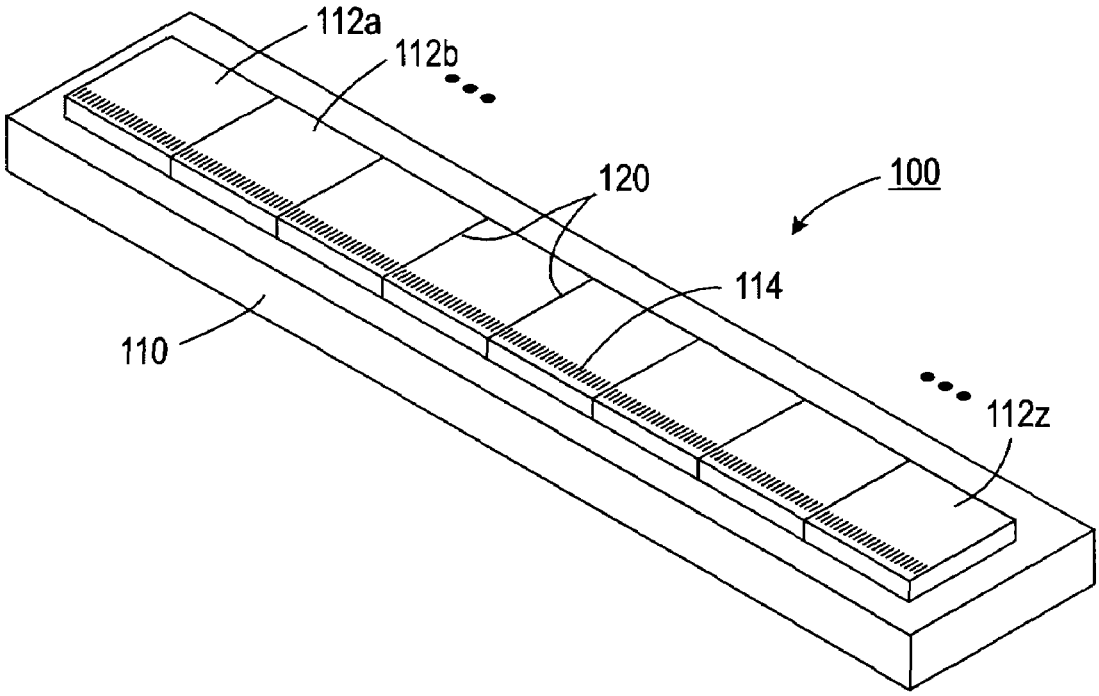
FIG. 4 (PRIOR ART)
FIG. 4 (prior art) is an elevational view showing the essentials of an image scanning array.

FIG. 4 shows the essential portions of an imaging scanning array 100, in which a substrate 110 has a plurality of silicon chips 112*a*, 112*b*, . . . 112*z* assembled end-to-end and mounted thereon. Also defined on each chip 112*a*, 112*b*, . . . 112*z* is a set of photosensors 114. These structures may be, by way of example and not limitation, photosensors in a CCD, photogates, or CMOS photodiodes.

The most common primary material for chips 112*a*-112*z* is crystalline silicon. A substance for forming substrate 110 is the board sold under the tradename CERACOM, made by Ibiden Corporation of Japan, which generally comprises a ceramic core with a fiberglass resin laminate thereon. Another material suitable for substrate 110 includes the printed wire board material known as "FR-4," or a relatively thin substrate of alumina.

On each chip 112 there is provided a large number (such as 250 or more) photosensors 114, which are separated by a largely consistent pitch, a pitch being defined as the distance between the centers of adjacent photosensors within a chip. In a full-width array, ideally the short pitches at the end photosensors will add up to the same pitch relative to end photosensors of adjacent chips.

When the chips 112 are assembled into a scanner, the linear array on each chip 112 combines with the others to form a single linear array. The apparatus may also comprise multiple linear arrays of photosensors on each chip, such as in a full-color scanner in which each linear array includes a filter for a particular primary color, or in a two-dimensional imaging scanner. In such a scanner, there will of course be a gap, here indicated as 120 in FIG. 4, between each adjacent pair of chips 112.

Figure 8:
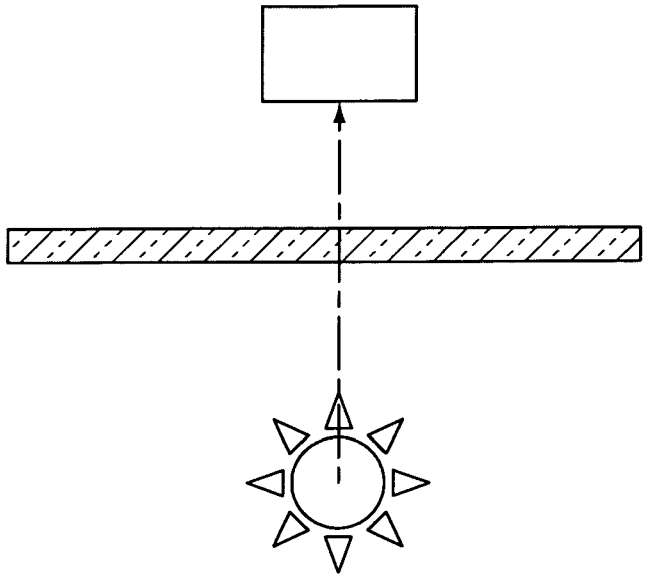
FIGS. 8-10 are pictorial illustrations illustrating transmissive, diffuse and specular transmission, respectively.
Figure 9:
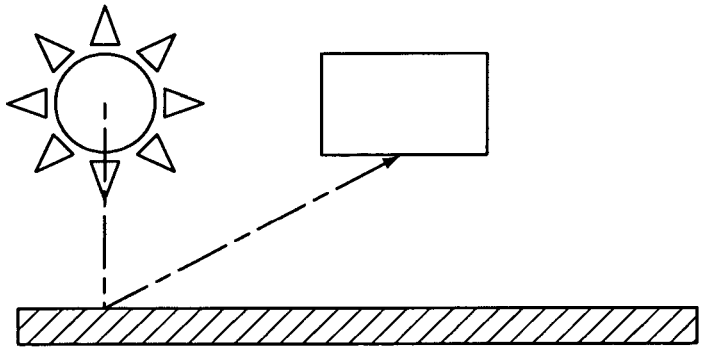
Figure 10:
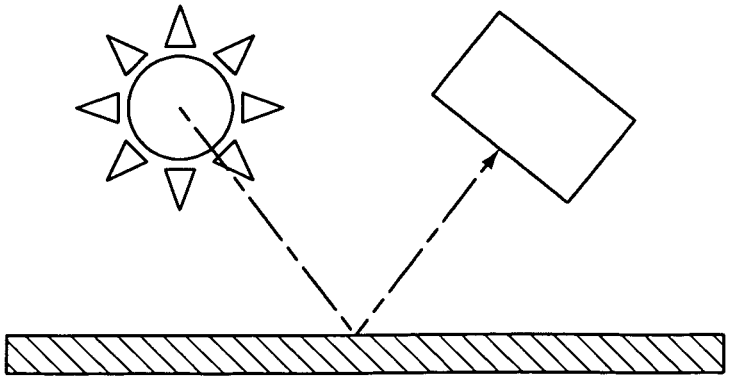

An FWA may operate in three modes, a transmissive mode (FIG. 8), a diffuse mode (FIG. 9), or a specular mode (FIG. 10). In a transmissive mode, the light source and sensor are on opposite sides of the photoreceptor (in this case a belt). Toner attenuates the transmission of the light. While such mode is sensitive to high masses, it may also respond to contamination on the back of the belt and internal structure in the belt. In diffuse mode, the angle of illumination and detection are different. The response of the sensor is small when there is no toner on the belt and increases as the presence of toner scatters the light. Diffuse mode imaging is not sensitive to black toner, which absorbs the light. In specular mode, the angle of illumination and angle of detection are equal. The sensor response is large when there is no toner on the belt, and the illumination source reflects directly into the detector. The sensor profile at high mass and zero mass, for example, can be used to calibrate the sensor uniformity.

While specular mode detection using a linear sensor array, such as a full width array ("FWA"), would offer advantages over a diffuse mode or transmissive mode, it suffers in that the sensor response in specular mode saturates at high masses, for example, when the belt is completely covered. Because the sensor saturates at high masses, it is not able to directly measure variations in high masses. Monitoring such high masses are frequently needed to stabilize the operation of electrophotographic printers.

FWAs can replace the functioning of ETACS if they were used for monitoring density of material on the photoreceptor, in particular given their widespread use in photoelectrographic machines. Monitoring in the specular mode would also provide a number of advantages over ETAC systems measuring both specular and diffuse light.

In order to make use of FWAs and other types of linear sensor arrays in the specular mode, in an embodiment it is proposed that a test pattern comprising a solid patch or solid area and one or more thin lines oriented in a process direction in association with said patch be used. In such solid patch-line test pattern, it is meant by a "solid patch" a filled shape comprising an area that does not approximate a thin line. The size of the patch is large enough so the developed mass is independent of edge effects. By "thin line," it is meant a line that does not approximate the shape of a filled rectangle, approximately less than about 100 μm in width. A thin line has the characterstic that its width significantly changes as the density of the toner in the solid patch changes.

Figure 5:
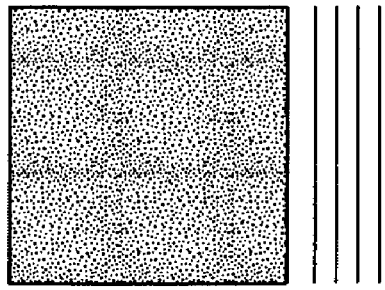
FIGS. 5-7 are illustrative test patches comprising solid patches and associated lines, useful in the present disclosure.
Figure 6:
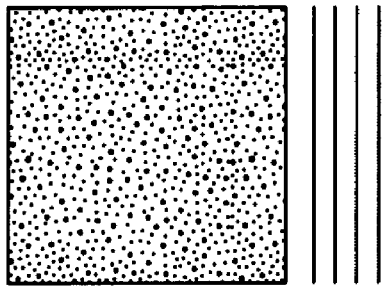
Figure 7:
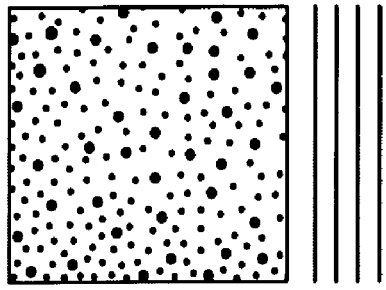

Exemplar test patterns of such embodiment comprising a filled square solid patch and four thin lines are shown in FIGS. 5, 6 and 7 wherein the process direction is in the vertical direction, and wherein the mass per unit area of material increases from FIG. 5 to FIG. 7. Using similar test patterns, change in the average linear sensor array response over the patch is proportional to the mass for low masses (e.g., FIG. 5). The line profile is taken from the average sensor response as a function of position in the cross process direction. The sensor response is a minimum over the center of the line and increases as the distance from the center of the line increases until it reaches the maximum specular response of the bare photoreceptor surface. The line width is measured by determining the crossing point of the line profile past some threshold on the left side of the line and the right side of the line. The side of the line is some threshold between the response at the line center and the response to the bare surface. Each sensor element may have noise due to the structure of the surface, the xerographic response, or sensor noise. Multiple lines are depicted, multiple lines helping to improve the accuracy of the measurement with averaging over the noise. A full width array has been found to be able to accurately measure the width of a line with an accuracy of a micron. The width of the process direction lines may vary by tens of microns as the developed mass increases from the point where the linear array sensor saturates to the maximum mass desired to be measured.

Figure 11:
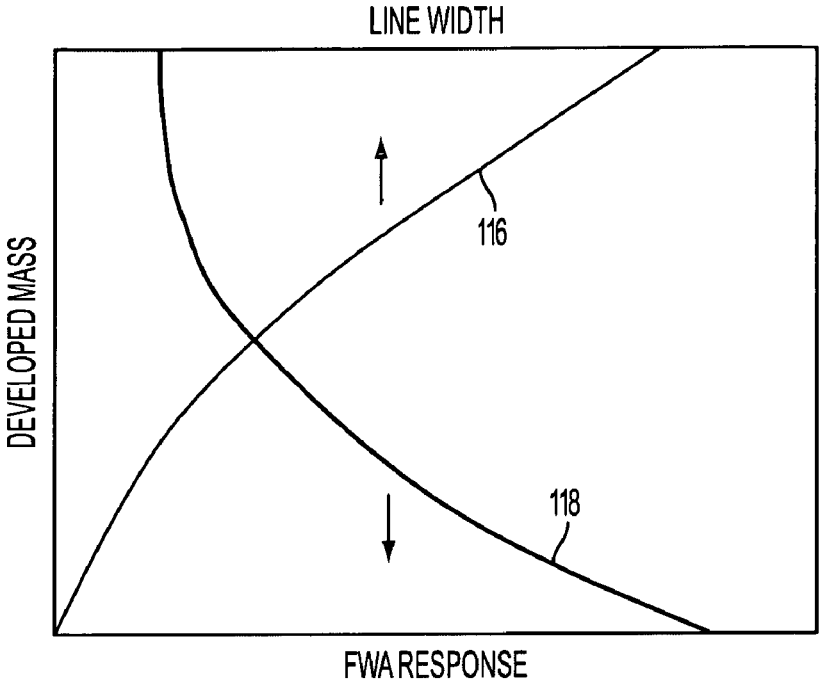
FIG. 11 is a graph of the response of a full width array ("FWA") to a solid patch and thin line test patch as a function of developed mass.
Figure 12:
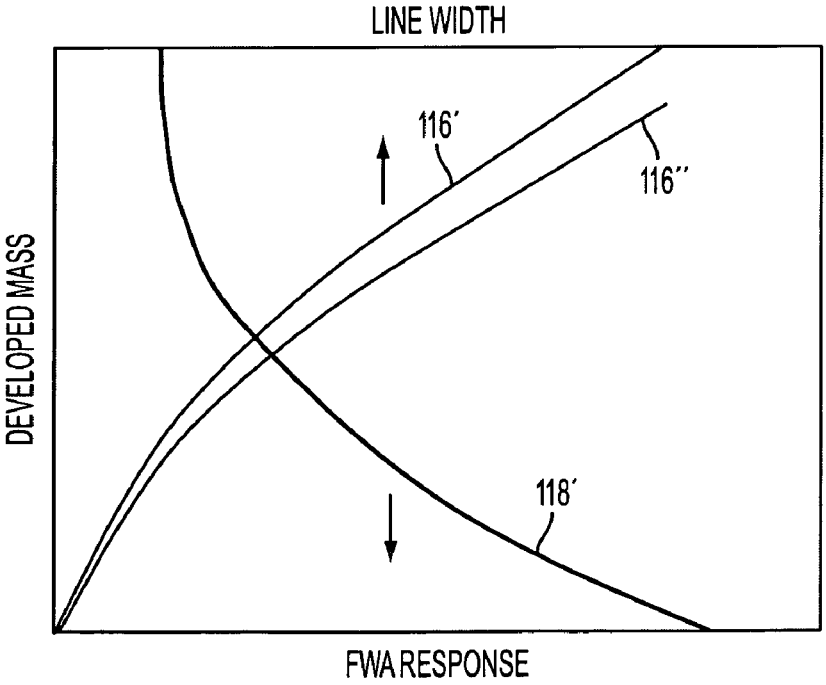
FIG. 12 is a graph of the response of a full width array ("FWA") to a solid patch and thin line test patch as a function of developed mass for toners having distinct particle size distributions.

By generating two calibration curves, such linear sensor array embodiment can generate an accurate TRC calibration. The low mass curve in such embodiment is generated by plotting the average linear sensor array (e.g., FWA) response over the area of the imaged patch versus the measured mass or optical density of the printed patch. The high mass curve is generated by plotting the average width of the line(s) determined by the array versus the measured mass or optical density of the printed patch. To calibrate the FWA, Vem (development voltage) can be swept and at each Vem a measurement made of the solid patch, the associated line width, and the developed mass or patch optical density on paper. FIG. 11 illustrates a schematic response of a full width array to a solid patch and a line (116) as a function of developed mass. The solid area (118) saturates at high developed masses. The line width measured is zero at low mass patches, because the electrostatic fields of the line are too weak to attract sufficient toner. At high masses however the line width continues to increase past the point where the solid patch has saturated. By measuring the actual mass (as, for example, done in prior ETAC based density monitoring systems) over the range of developed mass areas below saturation, one can obtain a line width response to mass relationship over a range of developed mass areas. Following such calibration sequence, by measuring line width, the developed mass area can be inferred.

In another embodiment, there is made provision for determining the appropriate high mass line calibration curve given that the width of lines may be sensitive to details of the electrophotographic process, such as the spot size of a laser ROS or toner size distribution. For example, a patch of 0.5 $mg/cm^2$ may develop a 100 μm wide double pixel (at 600 spi) line (e.g., for a large particle size distribution), while the line may be only 90 μm wide under other conditions (e.g., for a small particle sized distribution). To determine the appropriate line width calibration curve (see, e.g., FIG. 9, 116' v. 116") to extrapolate high masses, the line width measurement (116', 116") to the solid area measurement (118' of FIG. 9 at low masses is compared and forced to give the same result.

Figure 13:
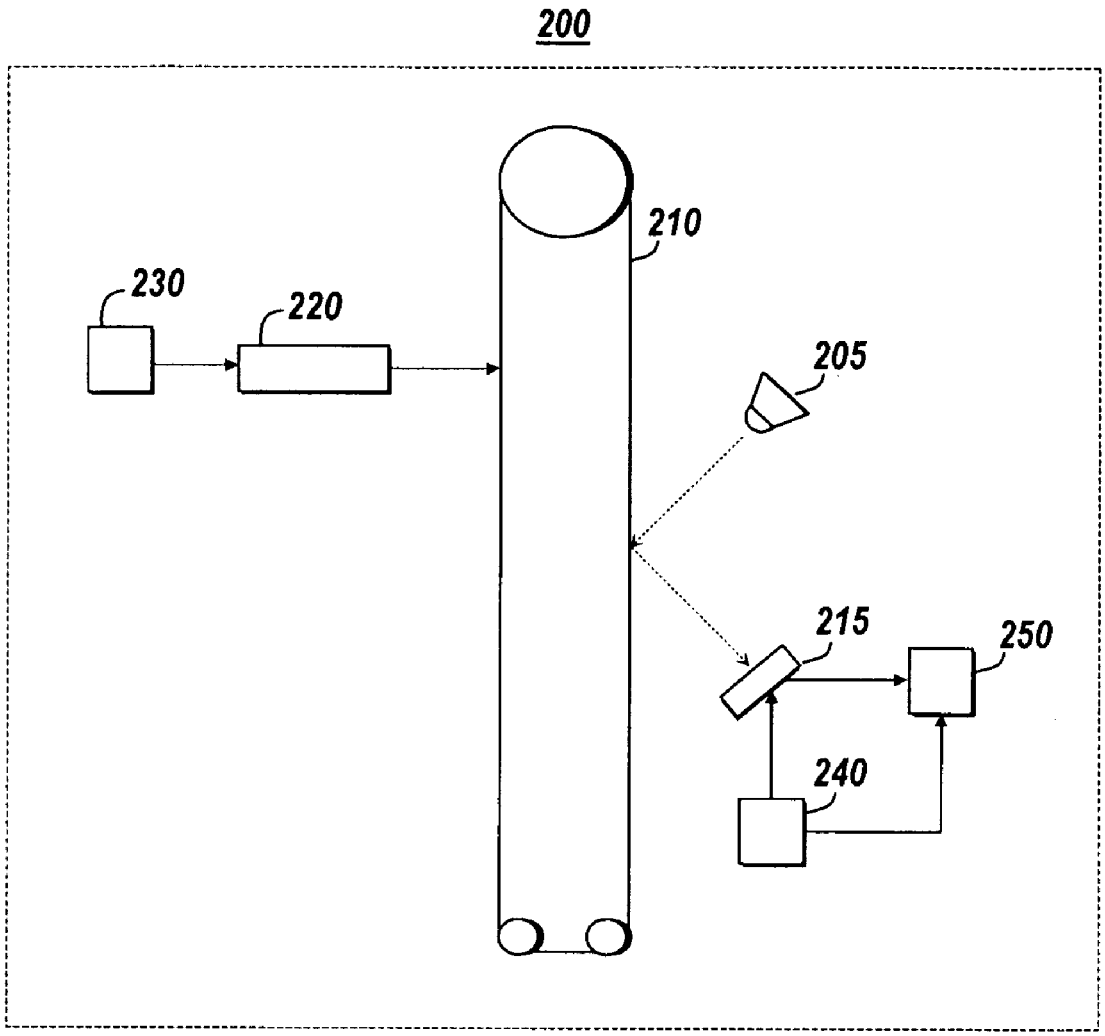
FIG. 13 is a functional block diagram depicting a system in accordance with an embodiment of the present invention.

In yet another embodiment, as depicted in FIG. 13, there is disclosed a system for improving image quality of a print from an electrophotographic printer 200. The electrophotographic printer 200 comprises an illuminator 205 providing light transmissions; a photoreceptor 210 positionally configured to receive light transmissions from the illuminator 205; a linear sensor array 215 comprising a plurality of sensors positionally configured with respect to the illuminator 205 and the photoreceptor 210 to obtain specular light transmissions from the photoreceptor 210 resulting from light transmissions from the illuminator 205; and a test patch printer 220 for printing test patches on the photoreceptor 210. The electrophotographic printer 200 further comprises a first processor 230 operationally associated with the test patch printer 220 and configured to cause the test patch printer 220 to print one or more test patches comprising a solid area patch in association with one or more solid lines on the photoreceptor 210; and a second processor 240 operationally associated with the linear sensor array 215 and operationally configured to process specular light transmissions received by the linear sensor array 215 to determine the average response of sensors on the linear sensor array 215 over the solid area patch of test patch and the width of lines associated with the solid area patch of test patch.

In such embodiment, both the first and second processors 230, 240 may be different or the same. The mass of one or more components of the test patches may be determined by a measurement system 250 that is under control of such processors. The linear sensor array 215 may be a full width array when color is involved. The system may also comprise one or more ETAC sensors.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of measuring variations in high mass on a media internal to a printer to improve image quality, the printer employing a linear sensor array containing a plurality of sensors, the method comprising:

printing a test patch of printing material onto the media comprising a solid area and one or more lines;

directing light onto the media to generate specularly reflected light transmissions to the linear sensor array;

determining the average response of the sensors of the linear sensor array to the specular reflectance over the solid area;

determining the width of said one or more lines; and supplying or making available the determined width for further analysis or processing.

2. A method in accordance with claim 1 wherein the test patch comprises more than one line.

3. A method in accordance with claim 1 wherein the linear sensor array comprises a full width array.

4. A method in accordance with claim 1 further comprising measuring the mass in said solid area of the test patch.

5. A method in accordance with claim 4 wherein the mass is measured by directly removing and weighing the printing material.

6. A method in accordance with claim 4 wherein the mass is measured by a sensor other than said linear sensor array.

7. A method in accordance with claim 4 wherein the mass is inferred by a sensor measuring the patch optical density or spectrophotographic response.

8. A method in accordance with claim 1 further comprising correlating the average response of said sensors regarding said solid area of the test patch to the developed mass on said solid area, and correlating the width of said lines to said measured mass of said solid area.

9. A method in accordance with claim 1 wherein the media internal to the printer comprises a photoreceptor belt or drum.

10. A method in accordance with claim 1 wherein the media internal to the printer comprises an intermediate belt or drum.

11. A system for improving image quality of a print from an electrophotographic printer, comprising:

an illuminator providing light transmissions;

a photoreceptor positionally configured to receive light transmissions from said illuminator;

a linear sensor array comprising a plurality of sensors positionally configured with respect to said illuminator and said photoreceptor to obtain specularly reflected light from said photoreceptor resulting from said light transmissions from said illuminator;

a test patch printer for printing test patches on said photoreceptor;

a first processor operationally associated with said test patch printer and configured to cause said test patch printer to print one or more test patches comprising a solid area patch in association with one or more solid lines on said photoreceptor; and a second processor operationally associated with said linear sensor array and operationally configured to process said specular light transmissions received by said linear sensor array to determine the average response of said sensors on said linear sensor array over the solid area patch of said test patch and to determine the width of said lines associated with said solid area patch of said test patch.

12. A system in accordance with claim 11 further comprising a measurement system operationally configured to determine the mass of one or more components of said test patches.

13. A system in accordance with claim 12 wherein said first and/or second processors are further operationally configured to cause said measurement system to determine said mass of said one or more of said test patches.

14. A system in accordance with claim 11 wherein the linear array sensor comprises a full width array.

15. A system in accordance with claim 11 wherein the photoreceptor comprises a belt.

16. A system in accordance with claim 11 wherein the system is incorporated in an electrophotographic printer.

17. A method of improving image quality of a print from an electrophotographic printer that includes an illuminator, a photoreceptor, and a linear sensor array with a plurality of sensors, the method comprising:

printing a test patch comprising toner material on the photoreceptor, said test patch comprising a solid area in proximity to a plurality of thin lines;

directing light from the illuminator onto the photoreceptor in order to generate specularly reflected light transmissions toward the linear sensor array;

processing the specular light transmissions received by the linear sensor array;

determining the average response of the sensors of the linear sensor array over the solid area of the test patch;

determining the width of the lines associated with the solid area of said test patch; and supplying or making available the determined width for further analysis or processing.

18. A method of claim 17 wherein said plurality of lines comprises three or more lines.

* * * * *